US006529113B2

(12) United States Patent
Endo et al.

(10) Patent No.: US 6,529,113 B2
(45) Date of Patent: Mar. 4, 2003

(54) PUSH-IN TYPE FUSE

(75) Inventors: Takayoshi Endo, Shizuoka (JP); Hiroki Kondo, Shizuoka (JP); Goro Nakamura, Shizuoka (JP); Norihiro Ohashi, Shizuoka (JP); Takahiro Satoh, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 9 days.

(21) Appl. No.: 09/849,973

(22) Filed: May 8, 2001

(65) Prior Publication Data

US 2001/0043139 A1 Nov. 22, 2001

(30) Foreign Application Priority Data

May 18, 2000 (JP) ..... 2000-146693

(51) Int. Cl.[7] ..... H01H 85/153; H01H 85/143

(52) U.S. Cl. ..... 337/198; 337/295; 337/290; 337/187; 439/843; 439/845

(58) Field of Search ..... 337/198, 290, 337/238, 295, 187, 261, 263; 439/842–856, 861, 862, 246, 249; 29/623

(56) References Cited

U.S. PATENT DOCUMENTS

| | | | | | |
|---|---|---|---|---|---|
| 4,570,147 | A | * | 2/1986 | Ebi | 337/166 |
| 4,672,352 | A | * | 6/1987 | Takano | 337/260 |
| 4,871,990 | A | * | 10/1989 | Ikeda et al. | 337/238 |
| 4,958,426 | A | * | 9/1990 | Endo et al. | 219/121.12 |
| 5,186,664 | A | * | 2/1993 | Abe | 439/843 |
| 5,398,015 | A | * | 3/1995 | Kudo et al. | 337/255 |
| 5,416,461 | A | * | 5/1995 | Totsuka et al. | 337/261 |
| 5,581,225 | A | * | 12/1996 | Oh et al. | 337/261 |
| 5,655,927 | A | * | 8/1997 | Maue et al. | 439/510 |
| 5,679,034 | A | * | 10/1997 | Hanazaki et al. | 439/845 |
| 5,745,024 | A | * | 4/1998 | Ohta et al. | 337/166 |
| 5,781,094 | A | | 7/1998 | Nakamura et al. | 337/238 |
| 5,818,321 | A | * | 10/1998 | Muramatsu et al. | 337/198 |
| 5,883,560 | A | * | 3/1999 | Nakamura et al. | 337/152 |
| 5,883,561 | A | * | 3/1999 | Nakamura et al. | 337/159 |
| 5,929,740 | A | * | 7/1999 | Oh et al. | 337/180 |
| 6,144,283 | A | * | 11/2000 | Matsumura | 29/623 |

FOREIGN PATENT DOCUMENTS

| | | | | |
|---|---|---|---|---|
| EP | 0228490 A1 | * | 12/1985 | H01H/85/00 |
| EP | 633592 A1 | * | 1/1995 | H01H/85/045 |
| JP | 61-166449 A | * | 10/1986 | |
| JP | 64-60937 A | * | 3/1989 | H01H/85/04 |
| JP | 02-066828 A | * | 3/1990 | H01H/85/56 |
| JP | 02-199735 A | * | 8/1990 | H01H/85/56 |
| JP | 06-48149 A | * | 6/1994 | H01H/85/04 |
| JP | 9-147732 | | 6/1997 | H01H/85/22 |
| JP | 9-204872 | | 8/1997 | H01H/85/36 |

OTHER PUBLICATIONS

Patent Abstracts of Japan. JP 09–147732. Jun. 6, 1997.
Patent Abstracts of Japan. JP 09–204872. Aug. 5, 1997.

* cited by examiner

*Primary Examiner*—Anatoly Vortman
(74) *Attorney, Agent, or Firm*—Sughrue Mion, PLLC

(57) ABSTRACT

A presser spring (43) is separately formed with a fuse body (33), and therefore may be formed of a material having a high spring characteristic. The presser spring (43) is attached to a portion of peripheral wall portions **(41*b*) to which a back plate portion (41*a*) is opposed, so that a mating tab terminal (39), inserted in an engagement space (45), is pressed against the back plate portion (41*a*) by the presser spring (43)**.

2 Claims, 7 Drawing Sheets

PRIOR ART

PRIOR ART

PRIOR ART

PUSH-IN TYPE FUSE

BACKGROUND OF THE INVENTION

1. Field of the Invention

The present invention relates to a push-in type fuse for use in an electric circuit of an automobile or the like. More particularly, the present invention relates to improvements of a push-in type fuse having a fuse body in which a pair of female terminal portions are integrally formed at both ends of a fusible conductor portion having a fusing portion, as well as a housing for accommodating and holding the fuse body.

The present application is based on Japanese Patent Application No. 2000-146693, which is incorporated herein by reference.

2. Description of the Related Art

FIGS. 7 to 9 show related examples of a fuse which is used in an electric circuit of an automobile or the like.

A high rated fuse 1 shown in FIGS. 7 and 8 is comprised of a fuse body 2 formed of a metallic plate, a housing 3 formed of an insulating resin for accommodating and holding the fuse body 2 through an upper opening 3*a*, and a cover 4 formed of an insulating resin for covering the upper opening 3*a* of the housing 3.

In the fuse body 2, a substantially strip-shaped fusible conductor portion 2*a* having a fusing portion C and a pair of terminal portions 2*b* located at both ends of the fusible conductor portion 2*a* are integrally formed by a metallic plate.

Each of the terminal portions 2*b* is a so-called twist-on terminal in which a screwing hole 2*c* is formed. As shown in FIG. 8, the terminal portion 2*b* is fastened and fixed by a male screw member (bolt) 10 to a screwing nut 8, which is provided in a fuse fitting portion 7 of a fuse box, together with an LA terminal 9*a* connected to one end of an electric wire 9 of a circuit on the fuse fitting portion side, thereby allowing the terminal portion 2*b* to be set in an electrically and mechanically connected state.

FIG. 9 illustrates a fuse body 12 of the so-called push-in type fuse.

In this fuse body 12, a substantially strip-shaped fusible conductor portion 13 having a fusing portion 13*a* and a pair of female terminal portions 15 provided at both ends of the fusible conductor portion 13 and adapted to be engaged with and connected to a pair of mating tab terminals 14 in a circuit on the fuse fitting portion side are integrally formed by a metallic plate.

Each of the female terminal portions 15 is comprised of a back plate portion 16 formed by extending an end portion of the fusible conductor portion 13, as well as a pair of peripheral wall portions 19*a* and 19*b* which respectively extend from both side edges of the back plate 16, are formed by being bent with their tip portions abutting against each other at a position opposing the back plate portion 16, and form together with the back plate portion 16 an engagement space 18 into which the mating tab terminal 14 is fitted.

In the same way as with the fuse body 2 shown in FIG. 7, the fuse body 12 is accommodated and held in an unillustrated housing formed of an insulating resin. A terminal lance 21 which is retained in the housing is formed in the back plate portion 16 by being cut out. A pair of presser springs 23 for pressing and urging the mating tab terminals 14 inserted in the engagement spaces 18 against the respective back plate portions 16 are integrally formed at portions of the pair of peripheral wall portions 19*a* and 19*b* opposing the respective back plate portions 16.

In a state in which the fuse body 12 is accommodated and held in the housing formed of an insulating resin, the fuse body 12 is inserted and fitted in the fuse fitting portion where the mating tab terminals 14 are provided uprightly, and as the mating tab terminals 14 are fitted in the engagement spaces 18, the fuse body 12 is set in a state of being electrically and mechanically connected to the mating tab terminals 14.

However, with the high rated fuse shown in FIGS. 7 and 8, the terminal portions 2*b* are so-called twist-on terminals, and the screwing nuts 8 and the male screw members 10 are required as separate parts.

Accordingly, there have been problems in that the cost becomes high due to an increased number of the parts, and that the operating efficiency of assembly is not good since the operation of tightening the male screw members 10 is required at the time of fitting the fuse.

In addition, with the push-in type fuse shown in FIG. 9, the pair of presser springs 23 for pressing and urging the mating tab terminals 14 inserted in the engagement spaces 18 against the respective back plate portions 16 are formed integrally with the fuse body 12.

Accordingly, in a case where, in order to improve the contact pressure of the mating tab terminal 14 with respect to the back plate portion 16 by strengthening the spring characteristic of the presser spring 23, for example, a material of a high spring characteristic is selected as the metallic plate used, or the thickness of the presser spring 23 is made large, there arise problems in that an increase in the electrical resistance between the pair of female terminal portions 15 can result, and that the formability declines.

Namely, in general, a material having a high spring characteristic has low electrical conductivity, and can therefore cause an increase in the electrical resistance of the fuse body 12. In addition, if the thickness is too large, there is a possibility that a crack may occur in a bent portion at the time of forming the presser spring 23 in the fuse body 12 by bending, so tat the thickness cannot be made extremely large.

Accordingly, the electrical resistance of the push-in type fuse such as the one described above is large, and therefore cannot cope with a high rated fusing characteristic of 100 amperes or higher.

In addition, the electrical path from the back plate portion 16 in contact with the mating tab terminal 14 to the fusible conductor portion 13 assumes a form of detouring the surrounding portions of the terminal lance 21 due to the cutout of the terminal lance 21 which is present midway. Therefore, there has been a problem in that an increase in the current path results, leading to an increase in the circuit resistance between the pair of female terminal portions 15.

SUMMARY OF THE INVENTION

Accordingly, it is an object of the present invention to provide a push-in type fuse which makes it possible to improve the spring characteristic of the presser springs at the female terminal portions and make it possible to reduce the circuit resistance between the female terminal portions and to cope with a high rating, thereby overcoming the above-described drawbacks of the related art.

To achieve the above object, according a first aspect of the present invention, there is provided a fuse which comprises:

a fuse body including a fusible conductor portion having a fusing portion, and a pair of female terminal portions integrally formed with end portions of the fusible conductor portion, wherein each of the female terminal portions includes a back plate portion extended from one of the end portions of the fusible conductor portion, and a pair of peripheral wall portions extended respectively from opposite side edges of the back plate portion, the pair of peripheral wall portions being bent so as to oppose tip portions thereof to each other at a position opposing to the back plate portion, so that an engagement space into which a mating tab terminal is insertable is formed between the back plate portion and the pair of peripheral wall portions; and a presser spring separately formed with the fuse body, the presser spring being attached to a portion of the peripheral wall portions to which the back plate portion is opposed, so that the mating tab terminal inserted in the engagement space is pressed against the back plate portion.

In accordance with the above-described construction according to the first aspect of the present invention, since the presser spring is formed separately from the fuse body, it is possible to select the material and the thickness separately.

Accordingly, as for the fuse body, since a material having high electrical conductivity, though low in the spring characteristic, can be selected, the electrical resistance can be lowered by enlarging the thickness of the fusible conductor portion and the back plate portions.

In addition, as for the presser spring, since a material having a high spring characteristic, though low in electrical conductivity, can be selected, the degree of freedom in the design of the presser spring is enhanced, thereby making it possible to improve the contact pressure of the mating tab terminal with respect to the back plate portion.

Therefore, the fuse body is able to lower the electrical resistance between the pair of female terminal portions and cope with a high rated fusion characteristic even if the fuse is a push-in type fuse.

According to a second aspect of the present invention, it is preferable that the fuse according to the first aspect further comprises a housing in which the fuse body is insertable, and a terminal lance formed on and by partially cutting a portion of the peripheral wall portions which opposes to the back plate portion, wherein the terminal lance of the fuse body is engaged with the housing when the fuse body is inserted in the housing.

In this case, since the cutout of the terminal lance is not present in the current path from the back plate portion in contact with the mating tab terminal to the fusible conductor portion, a linear shortest path is formed, thereby making it possible to further reduce the circuit resistance between the pair of female terminal portions.

The above and other objects, features and advantages of the present invention will become more apparent from the following detailed description of the present invention when read in conjunction with the accompanying drawings.

BRIEF DESCRIPTION OF THE DRAWINGS

FIG. 6A is a plan view, FIG. 6B is a top view, FIG. 6C is a side elevational view, and FIG. 6D is a perspective view;

DETAILED DESCRIPTION OF THE PREFERRED EMBODIMENT

A preferred embodiment of the present invention now will be described with reference to FIGS. 1 to 6.

Figure 1:
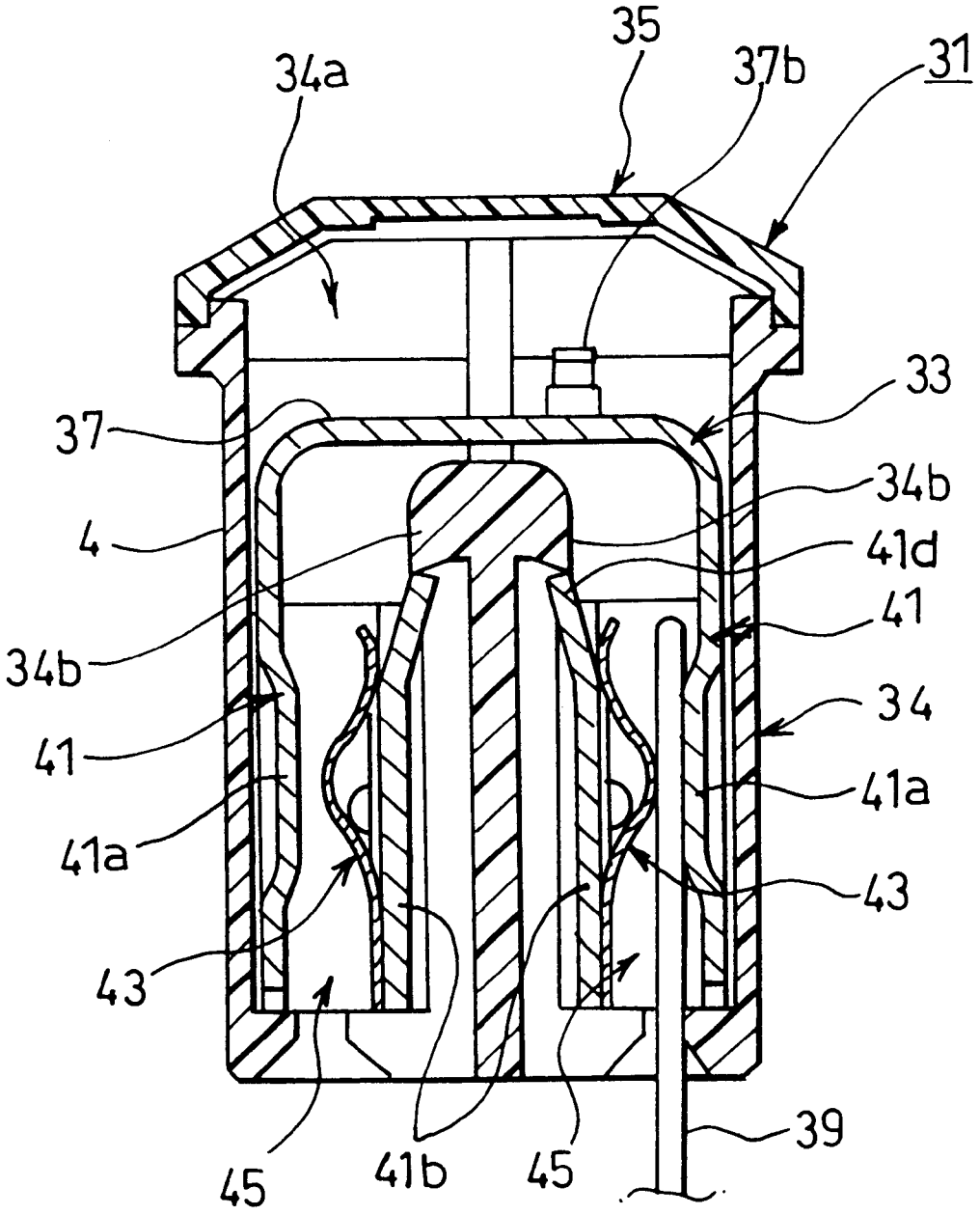
FIG. 1 is a vertical cross-sectional view of a push-in type fuse in accordance with an embodiment of the present invention.

As shown in FIG. 1, a push-in type fuse 31 in accordance with the embodiment comprises a fuse body 33 formed of a metallic plate, a housing 34 formed of an insulating resin for accommodating and holding the fuse body 33 inserted from an upper opening 34*a*, and a cover 35 formed of an insulating resin for covering the upper opening 34*a*.

Figure 2:
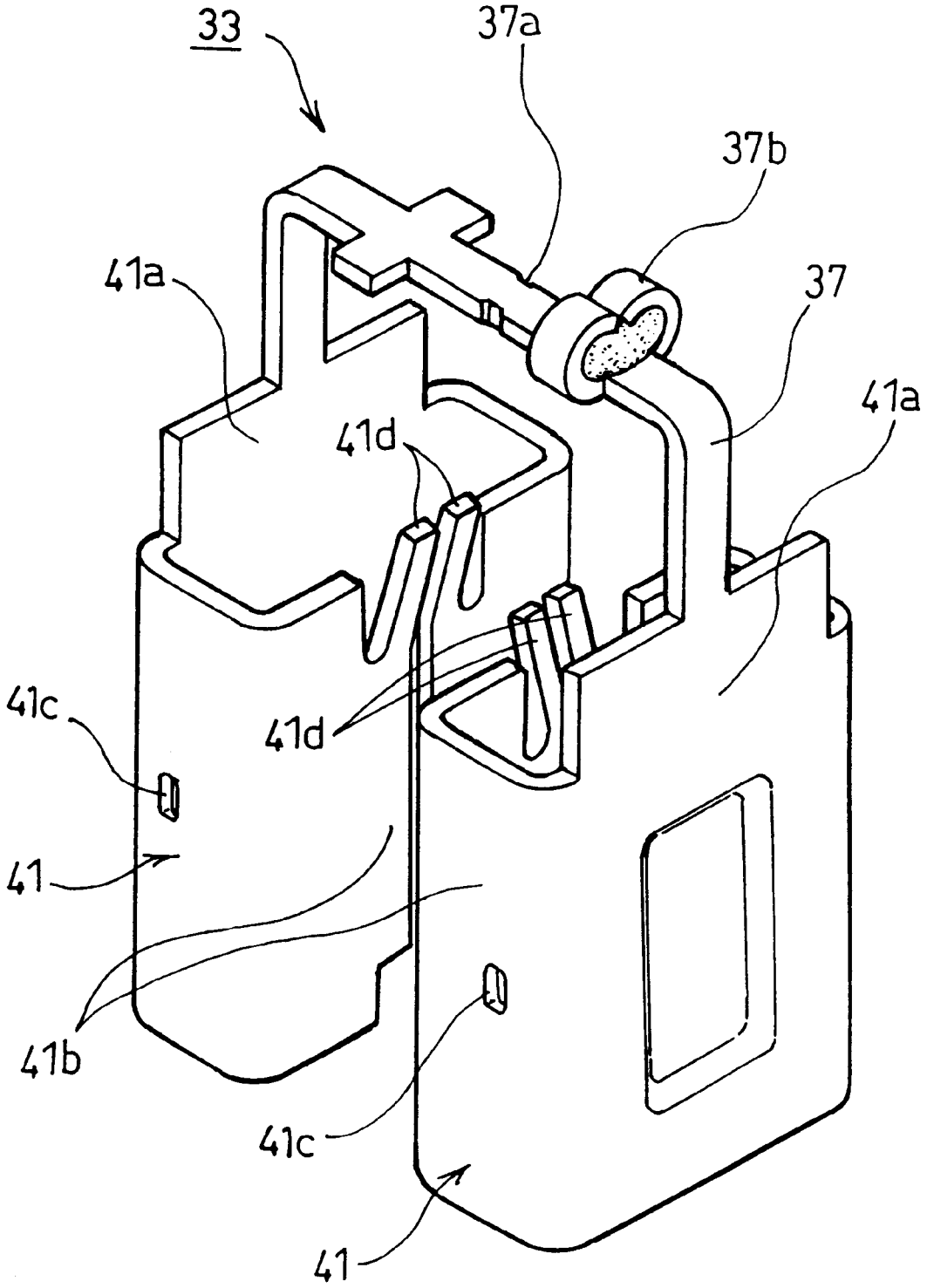
FIG. 2 is a perspective view of a fuse body in the push-in type fuse shown in FIG. 1.

As shown in FIG. 2, as for the fuse body 33, a substantially strip-shaped fusible conductor portion 37, which has a first fusing portion 37*a* and a second fusing portion 37*b*, and a pair of female terminal portions 41, which are respectively provided at both ends of the fusible conductor portion 37 and with which a pair of mating tab terminals 39 in a circuit on the fuse fitting portion side are engaged and connected, are integrally formed by a metallic plate of a material having high electrical conductivity.

The first fusing portion 37*a* is a neck portion which instantly fuses when an overcurrent which far exceeds a rated current has flowed. Meanwhile, the second fusing portion 37*b* is a portion where tips which are fused by a current slightly exceeding the rated current are caulked, and the second fusing portion 37*b* is so set as to fuse when the current slightly exceeding the rated current flows continuously for a fixed time duration or more.

Each of the female terminal portions 41 comprises a back plate portion 41*a* formed by extending an end portion of the fusible conductor portion 37, as well as a pair of peripheral wall portions 41*b* which respectively extend from both side edges of the back plate 41*a*, are formed by being bent with their tip portions abutting against each other at a position opposing the back plate portion 41*a*, and form together with the back plate portion 41*a* an engagement space 45 into which the mating tab terminal 39 is fitted.

Figure 4:
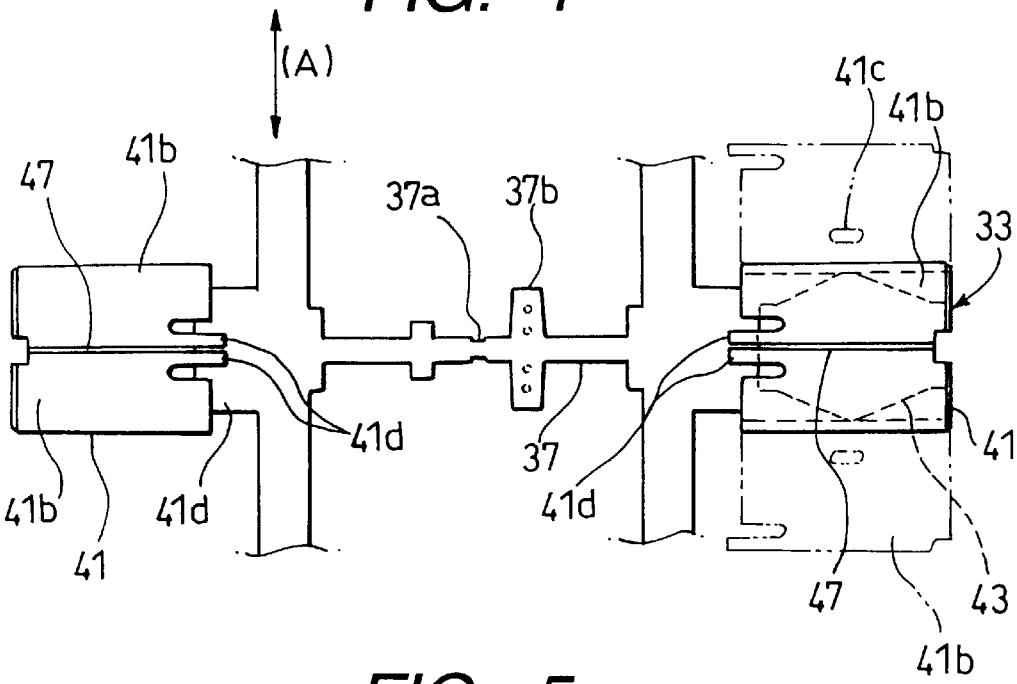
FIG. 4 is a plan view of the fuse body which is shown in FIG. 3 and which is in the process of being formed.

Further, a presser spring 43, which is formed separately from the fuse body 33, is attached to an abutment portion 47 side of the peripheral wall portions 41*b* opposing the back plate portion 41*a* of each female terminal portion 41 (see FIG. 4).

The presser spring 43 is formed of a material having a high spring characteristic, including stainless steel or a high-spring-characteristic copper alloy such as beryllium copper and phosphor bronze, and presses and urges the mating tab terminal 39 inserted in the engagement space 45 against the back plate portion 41*a*.

As shown in FIG. 6, the presser spring 43 has a pair of engaging projections 43*a* which are adapted to be retained in a pair of retaining holes 41*c* respectively formed in the peripheral wall portions 41*b* at the widthwise opposite ends of the female terminal portion 41. As these engaging projections 43*a* are retained in the retaining holes 41*c*, the presser spring 43 is held in such a manner as to be capable of being displaced toward the abutment portion 47 side inside the engagement space 45.

In addition, in the presser spring 43, their upper and lower end portions extending in the inserting direction of the mating tab terminal 39 are formed as tapered portions 43*b* for guiding the mating tab terminal toward the back plate portion 41*a* side. A pair of peripheral-wall abutting portions 43*c* for abutting against the peripheral walls 41*b* on the abutment portion 47 side are formed at a tip portion of each tapered portion 43*b*.

Figure 5:
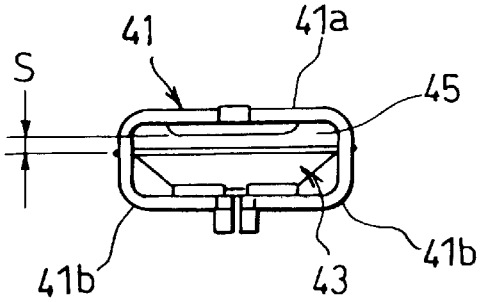
FIG. 5 is a bottom view of a female terminal portion in the fuse body shown in FIG. 4.
Figure 6A:
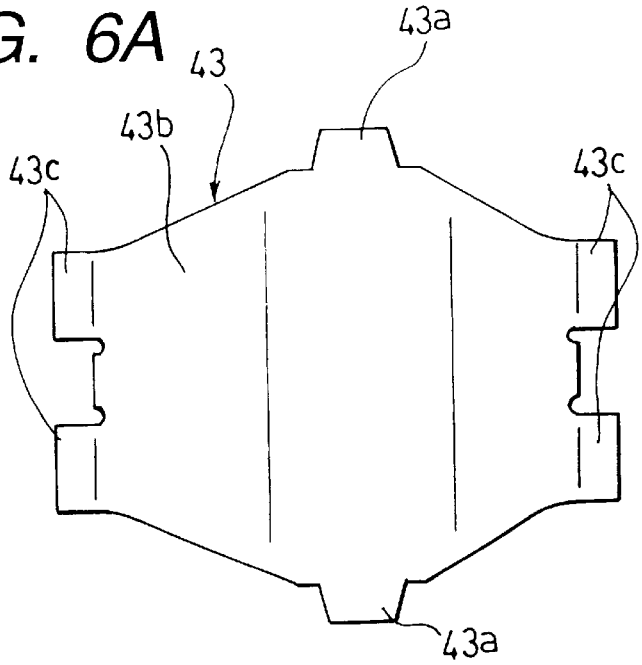
FIGS. 6A to 6D are enlarged views of a presser spring in the fuse body shown in FIG. 4, in FIG.
Figure 6B:
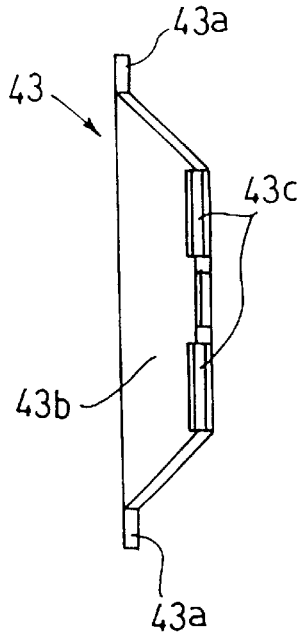
Figure 6C:
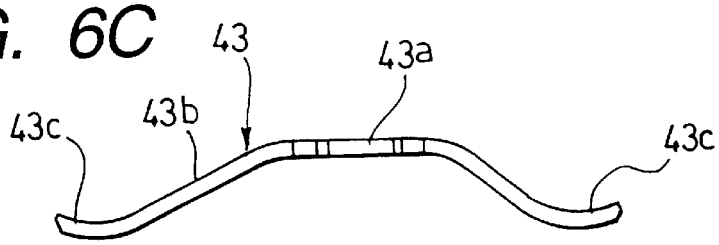
Figure 6D:
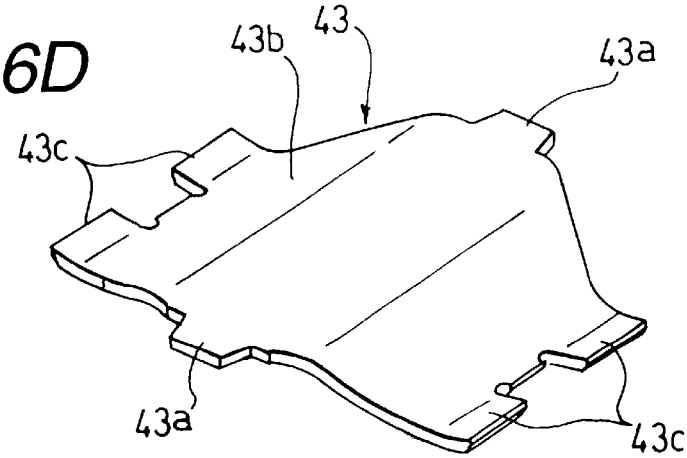

Namely, as shown in FIG. 5, the presser spring 43 is attached to the abutment portion 47 side of the pair of peripheral wall portions 41*b* in the female terminal portion 41, and forms together with the back plate portion 41*a* a gap S which can be enlarged when the mating tab terminal 39 enters.

In addition, in the case of this embodiment, two pairs of terminal lances 41*d* of the fuse body 33 which are retained inside the housing 34 are formed by being cut out on the abutment portion 47 sides of the peripheral wall portions 41*b* opposing the respective back plate portions 41*a*.

As shown in FIG. 1, when the fuse body 33 is inserted into the housing 34 through the upper opening 34*a*, the terminal lances 41*d* are retained by lance-retaining steps 34*b* provided in the housing 34 at positions close to the central portion, and are thereby prevented from coming off.

Figure 3:
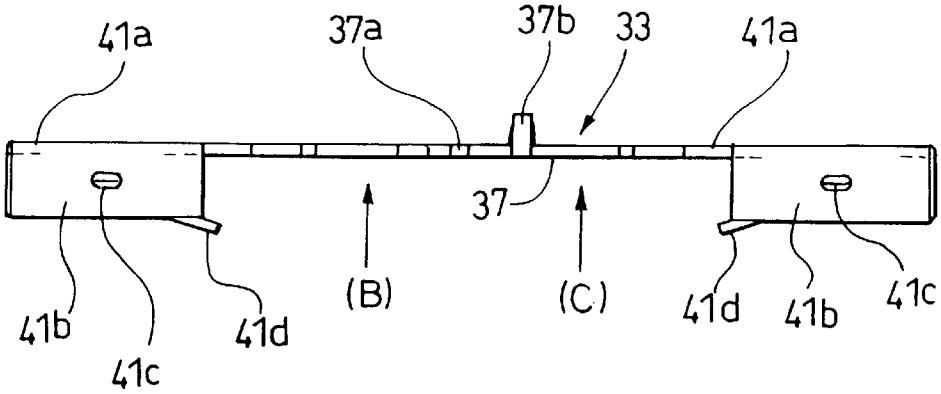
FIG. 3 is a front elevational view of the fuse body which is shown in FIG. 2 and which is in the process of being formed.

As shown by phantom lines in FIG. 4, the fuse body 33 is formed such that after blanks of predetermined shapes continuing in a chain form in the direction of arrow (A) are first punched out from a metallic plate, and after the female terminal portions 41 are press formed with the presser spring 43 assembled at a predetermined position, unnecessary portions are cut off, and bending at positions (B) and (C) shown in FIG. 3 is effected, thereby forming the fuse body 33 in the form shown in FIG. 2.

Then, as shown in FIG. 1, in a state in which the fuse body 33 is accommodated in the housing 34 formed of an insulating resin, the fuse body 33 is fitted in the fuse fitting portion where the mating tab terminals 39 are provided uprightly, and as the mating tab terminals 39 are fitted in the engagement spaces 45 and are connected, the fuse body 33 is set in a state of being electrically and mechanically connected to the mating tab terminals 39.

According to the push-in type fuse 31 in accordance with the above-described embodiment, since the presser spring 43 for pressing and urging against the back plate portion 41*a* the mating tab terminal 39 inserted in the engagement space 45 of each female terminal portion 41 is formed separately from the fuse body 33, it is possible to select the material and the thickness separately.

Accordingly, since a material having high electrical conductivity, though low in the spring characteristic, can be selected for the fuse body 33, it is possible to lower the electrical resistance by enlarging the thickness of the fusible conductor portion 37 and the back plate portion 41*a*.

In addition, since a material having a high spring characteristic, though low in electrical conductivity, can be selected for the presser spring 43, the degree of freedom in the design of the spring is enhanced, thereby making it possible to improve the contact pressure of the mating tab terminal with respect to the back plate portion 41*a*.

Therefore, the fuse body 33 is able to lower the electrical resistance between the pair of female terminal portions 41 and cope with a high rated fusion characteristic.

Furthermore, the terminal lances 41*d* are formed by being cut out on the abutment portion 47 side of the peripheral wall portions 41*b* opposing the back plate portion 41*a*.

Accordingly, since the cutout of the terminal lances is not present in the current path from the back plate portion 41*a* in contact with the mating tab terminal 39 to the fusible conductor portion 37, a linear shortest path is formed, thereby making it possible to further reduce the circuit resistance between the pair of female terminal portions 41.

Figure 9:
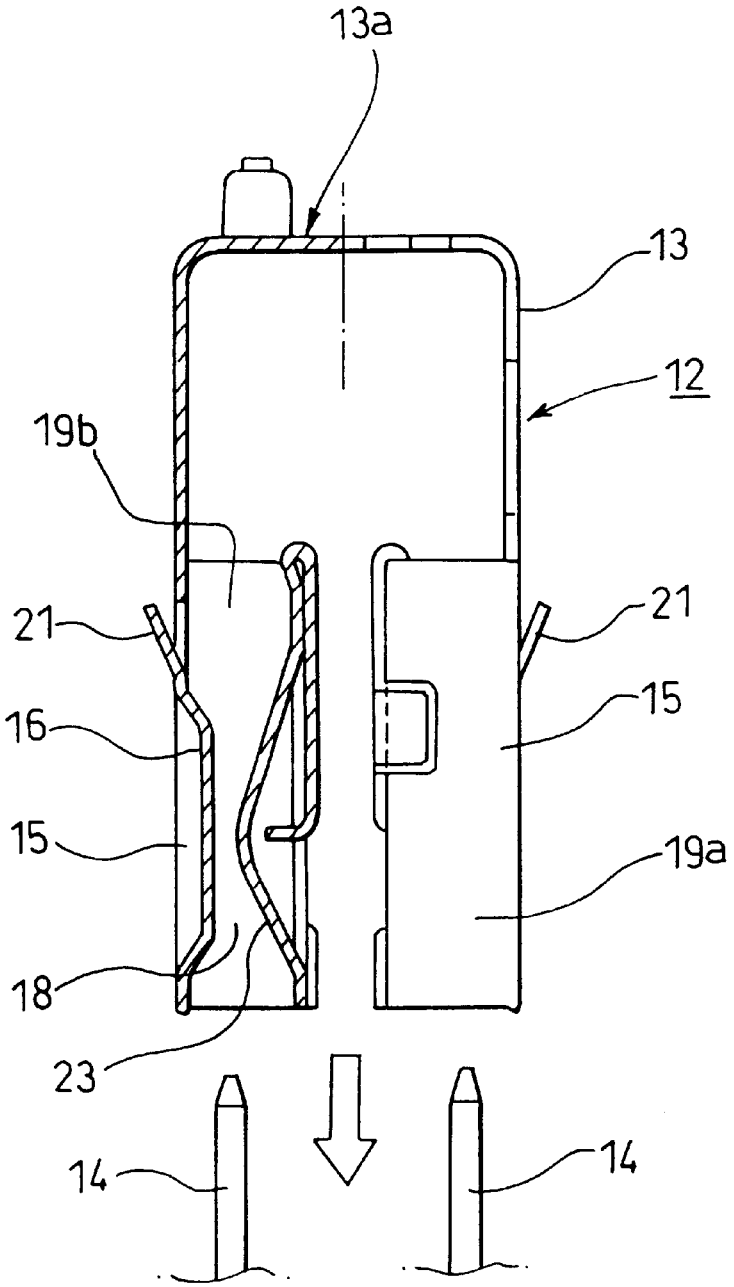
FIG. 9 is a partial vertical cross-sectional view of a fuse body in a related push-in type fuse.

In addition, since the terminal lances 41*d* are arranged in such a manner as to project toward the inner side of the fuse body 33, and are not arranged to project outside a fuse body 12 as in the terminal lance 21 shown in FIG. 9, it is possible to make the external dimensions of the fuse body 33 compact and make the fuse compact.

Namely, despite the fact that the push-in type fuse 31 in accordance with this embodiment is a push-in type fuse which effects electrical and mechanical connection between the mating tab terminals 39 and the fusible conductor portion 37 by the engagement between the mating tab terminals 39 on the fuse fitting portion side and the female terminal portions 41, it is possible to cope with the high rated fusion characteristic.

Figure 7:
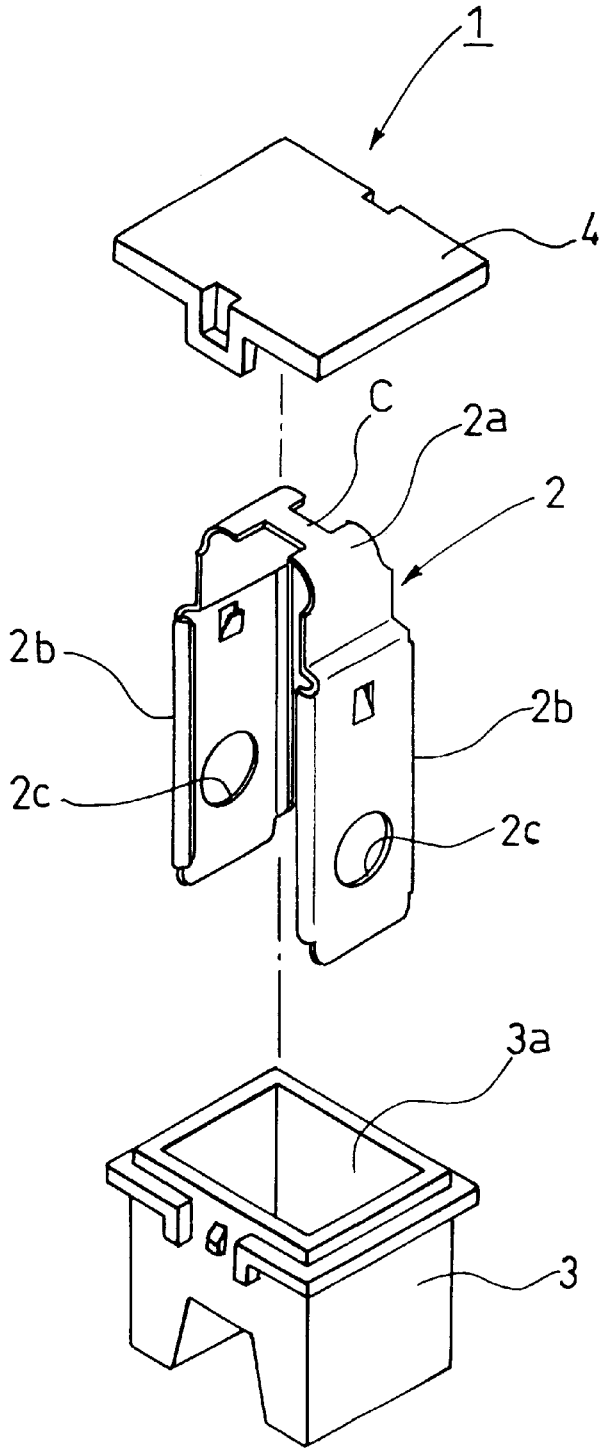
FIG. 7 is an exploded perspective view of a related high rated fuse.
Figure 8:
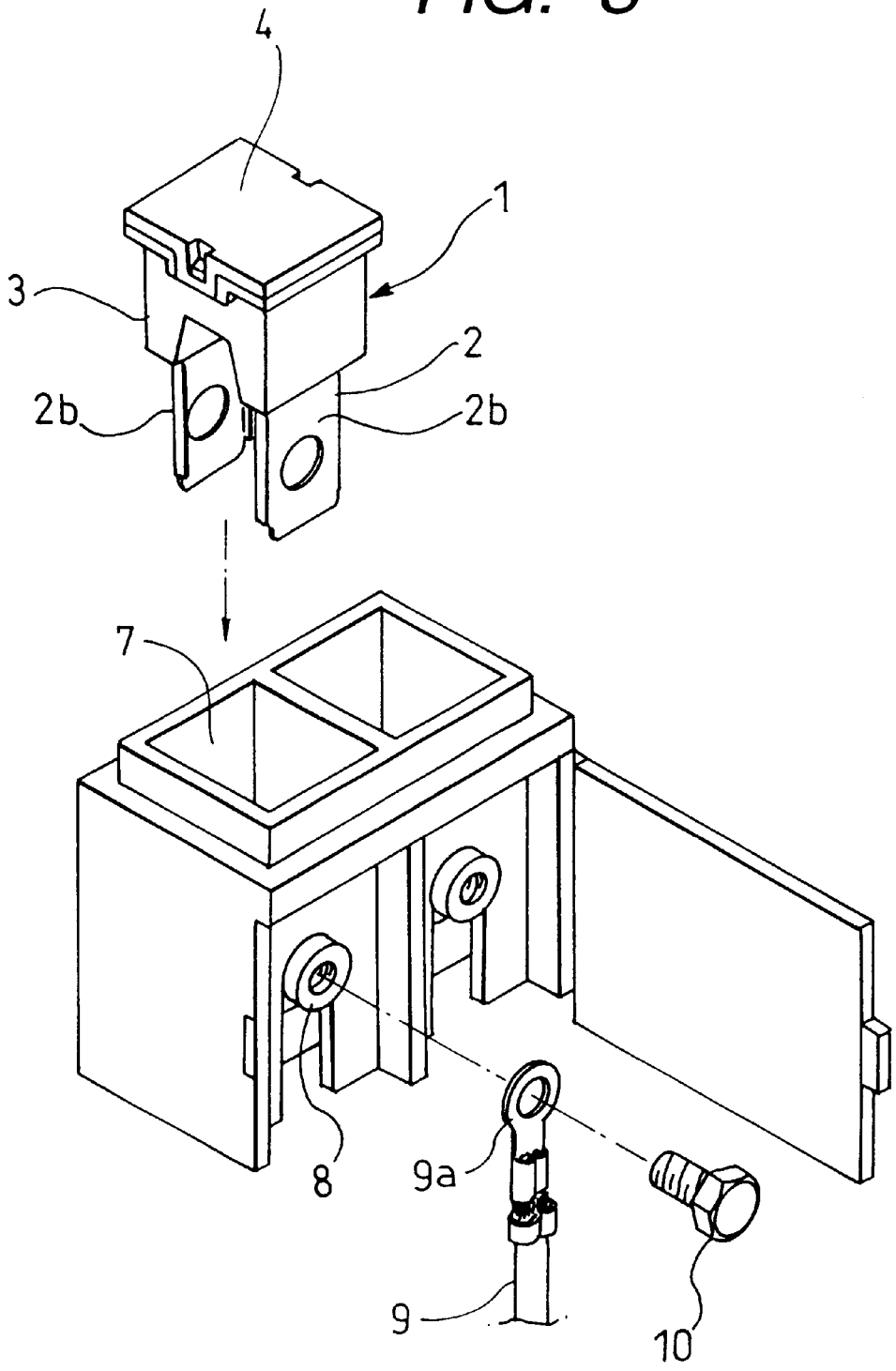
FIG. 8 an exploded perspective view explaining a state of assembly of the fuse shown in FIG. 7.

Accordingly, with the push-in type fuse 31, a situation does not occur in which, as with the high rated fuse 1 shown in FIGS. 7 and 8, the cost becomes high and the operating efficiency of assembly deteriorates due to the requirement of screwing nuts 8 and male screw members 10. Hence, it is possible to cope with a high rated fusing characteristic of 100 amperes or higher.

It should be noted that the push-in type fuse in accordance with the present invention is not limited to the construction of the fuse body 33, the housing 34, and the presser springs 43, and the like in the above-described embodiment, and it goes without saying that various constructions may be adopted on the basis of the gist of the present invention.

In addition, although the fusible conductor portion 37 in the above-described embodiment comprises the first fusing portion 37*a* and the second fusing portion 37*b*, the fusible conductor portion 37 may comprise either one of the fusing portions.

What is claimed is:

1. A fuse, comprising:

a fuse body including:

a fusible conductor portion having a fusing portion, and a pair of female terminal portions integrally formed with end portions of the fusible conductor portion, wherein each of the female terminal portions includes:

a back plate portion extended from one of the end portions of the fusible conductor portion, and a pair of peripheral wall portions extended respectively from opposite side edges of the back plate portion, the pair of peripheral wall portions being bent so as to oppose tip portions thereof to each other at a position opposing to the back plate portion, so that an engagement space into which a mating tab terminal is insertable is formed between the back plate portion and the pair of peripheral wall portions; and a presser spring separately formed with the fuse body, the presser spring being attached to a portion of the peripheral wall portions to which the back plate portion is opposed, so that the mating tab terminal inserted in the engagement space is pressed against the back plate portion.

2. The fuse of claim 1, further comprising:

a housing in which the fuse body is insertable; and a terminal lance formed on and by partially cutting a portion of the peripheral wall portions which opposes to the back plate portion, wherein the terminal lance of the fuse body is engaged with the housing when the fuse body is inserted in the housing.

* * * * *